United States Patent [19]

Yanagida et al.

[11] 4,202,481

[45] May 13, 1980

[54] STAPLER FOR BROAD CENTER BEAM STAPLES

[76] Inventors: Jun Yanagida, 723-140, Kashiay, Kannamie-cho, Tagata-gun Shizuoka-ken; Souichiro Ishikawa, 2-27-12, Kasuga-cho, Nerima-ku, Tokyo-to; Kazutada Nakazawa, 5-26-19, Kamisaginomiya Nakano-ku, Tokyo-to, all of Japan

[21] Appl. No.: 932,554

[22] Filed: Aug. 10, 1978

[30] Foreign Application Priority Data

Aug. 24, 1977 [JP] Japan ..... 52/112222[U]

[51] Int. Cl.[2] ..... B25C 5/02

[52] U.S. Cl. ..... 227/145; 227/113; 227/139

[58] Field of Search ..... 227/113, 119, 139, 145

[56] References Cited

U.S. PATENT DOCUMENTS

| | | | |
|---|---|---|---|
| 1,408,823 | 3/1922 | Muth | 227/139 |
| 1,554,686 | 9/1925 | Muth | 227/139 |
| 1,820,224 | 8/1931 | Havener | 227/139 |
| 2,473,253 | 6/1949 | La Place | 227/139 |

FOREIGN PATENT DOCUMENTS

| | | | |
|---|---|---|---|
| 1447962 | 9/1976 | United Kingdom | 227/113 |

*Primary Examiner*—John McQuade
*Attorney, Agent, or Firm*—Polster, Polster and Lucchesi

[57] ABSTRACT

A stapling machine adapted for use with a special configuration of a wire staple comprising a base plate having a wire staple receiving mold or recess in one end portion thereof an upright flanged portions at both sides on the opposite ends thereof; a wire staple holding frame in a cylindrical configuration having a cross-sectional shape conforming to the shape of an ornamental wire staple having a broadened center beam section which is wider than the staple points or legs at both sides thereof, and a leaf spring connected at one end thereof with the wire staple holding frame, and the other end being partially bent in a U-shape to provide a repulsive force and partially formed into a hook-shape; a pressure applying member including at one end portion thereof a wire staple extruding member formed in a fork-shape to freely slide into and out of grooves formed in said wire staple holding frame and a pair of upright flanged portions at both sides of the other end thereof forming a bearing for a shaft so as to be pivotally connected with the upright flanged portions provided on the base plate; and a magnet to attract and hold in position the wire staple placed in the staple wire holding frame.

2 Claims, 9 Drawing Figures

STAPLER FOR BROAD CENTER BEAM STAPLES

BACKGROUND OF THE INVENTION

This invention relates to a stapling machine, and more particularly, it is concerned with an improvement in a miniaturized type of such stapling machine adapted for use with ornamental wire staples in a special form, in which the center part of the horizontal beam section between the legs or points of the U-shaped wire staple is made wider than the leg portions and shaped in, for example, a circular, hexagonal, or other fancy configuration for ornamental purposes, and arbitrary designs, patterns, symbols, pictures, and so on are printed on the top surface of the broadened center beam part.

SUMMARY OF THE INVENTION

It is the primary object of the present invention to provide a stapling machine of a particular construction to accurately hold in a predetermined direction and position the wire staple having a special surface configuration on the top center part of the beam of the U-shaped wire staple.

It is the secondary object of the present invention to provide a stapling machine of a particular construction, in which the wire staple holding member is in a cylindrical shape having a cross-sectional configuration thereof to conform to the shape of the center top part of the wire staple, and a magnet to maintain in position the wire staple is provided in one part of a pressure applying member to extrude the wire staple.

According to the present invention, generally speaking, there is provided a stapling machine comprising in combination: (a) a base plate having a staple wire receiving recess or mold on one end part thereof and upright flanged portions at both sides on the opposite ends thereof; (b) a wire staple holding means in a cylindrical configuration having a cross-sectional shape conforming to the shape of an orgamental wire staple having a broadened center beam section which is wider than the staple points or legs at both sides thereof, and a leaf spring connected at one end thereof with said wire staple holding frame, and the other end being partially bent in a U-shape to provide a repulsive spring force and partially formed into a hook shape; (c) a pressure applying member including at one end portion thereof a wire staple extruding member formed in a fork shape to freely slide into and out or grooves formed in said wire staple holding means and a pair of upright flanged portions at both sides of the other end part thereof forming a bearing to receive a shaft so as to be pivotally connected with the upright flanged portions provided on the base plate; and (d) a magnet to attract and hold in position the wire staple placed in said wire staple holding frame.

There has thus been outlined rather broadly the more important features of the present invention in order that the detailed description thereof that follows may be better understood, and in order that the present contribution to the art may be better appreciated. There are, of course, additional features of the invention that will be described hereinafter and which will form the subject of the claims appended hereto. Those skilled in the art will appreciate that the conception, upon which this disclosure is based may readily be utilized as a basis for the designing of other structures for carrying out the several purposes of the present invention. It is important, therefore, that the claims be regarded as including such equivalent construction so far as they do not depart from the spirit and scope of the present invention.

BRIEF DESCRIPTION OF THE ACCOMPANYING DRAWINGS

Specific embodiments of the present invention have been chosen for the purpose of illustration and description, and are shown in the accompanying drawing, forming a part of the specification, in which.

DETAILED DESCRIPTION OF PREFERRED EMBODIMENTS

Figure 1:
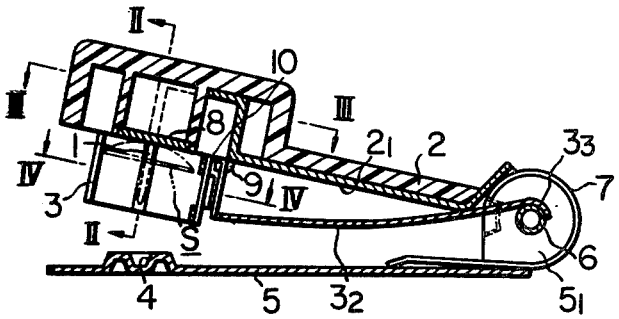
FIG. 1 is a side elevational view in longitudinal cross-section along the center line of the stapling machine according to the present invention.
Figure 6:
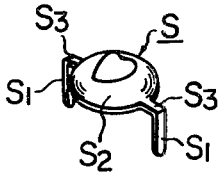
FIG. 6 is a perspective view of the ornamental wire staple for use in the stapling machine according to the present invention.
Figure 2:
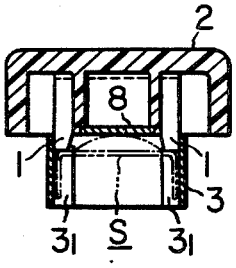
FIG. 2 is a longitudinal cross-sectional view taken along the line II—II in FIG. 1.
Figure 5:
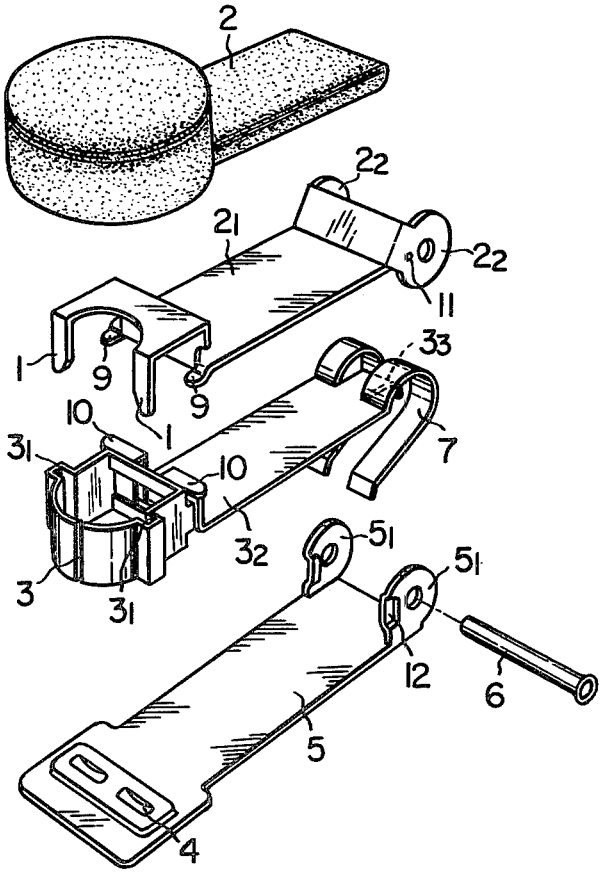
FIG. 5 is an exploded perspective view of the stapling machine according to the present invention.
Figure 3:
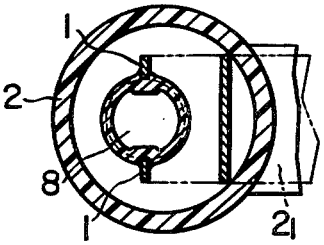
FIG. 3 is a transverse cross-sectional view taken along the line III—III in FIG. 1.
Figure 4:
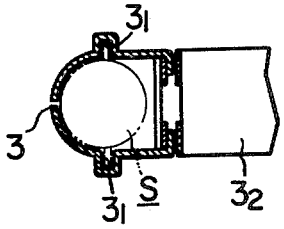
FIG. 4 is another transverse cross-sectional view taken along the line IV—IV in FIG. 1.

Referring to FIGS. 1, 2 and 4, a magnet 8 is provided inside a head portion of an ornamental cover member 2 for a pressure applying plate member 2. When an ornamental wire staple 5 having a broadened center beam section $5_2$ is inserted into a wire staple holding frame 3 provided beneath the pressure applying plate member 2, with the downwardly directing staple points or legs $5_1$, $5_1$ being fitted in the grooves $3_1$ of the staple holding frame 3, the top outer surface of the broadened center beam part of the wire staple is attracted by the magnet 8 and held at its determined position. When a desired number of sheets of paper to be bound together are placed in a space between the wire staple holding frame 3 and a base plate 5, and the pressure applying plate member 2, is pressed downward at its head portion against force of a spring 7, the bottom end face of the wire staple holding frame 3 first contacts the top paper surface and, upon further depression, the wire staple 5, in its state of being held by the magnet 8 at its top outer surface of the broadened center beam section $5_2$, is pressed down at its both shoulder portions by means of wire staple extruding projections, 1, 1 fixedly provided on both sides of the magnet at positions to slide into the grooves $3_1$, $3_1$ of the wire staple holding frame 3, whereby the staple points $5_1$, $5_1$ pierce through the paper and bent inwardly along the shape of the wire staple receiving recess 4 formed in the base plate 5.

When the pressure applying head member 2, is released, it returns to its upward direction by the force of the spring 7 accompanying the wire staple holding frame 3. Reference numerals 9 and 10 respectively designate pawls and pawl receiving projections to be mutually engaged in the upwardly moving direction alone to accompany the wire staple holding frame 3 when the pressure applying plate member 2, moves upward to return to its original position.

The wire staple extruding projections 1, 1, as stated above, may be caused to centralize its pressing force on both top ends of the staple points $5_1$ of the wire 5, i.e., on both shoulder portions $5_3$, $5_3$ for the effective depression of the wire staple, hence the bottom end of the wire staple extruding projections 1, 1 may preferably be formed in a fork shape. Also, when magnetic rubber is used as the permanent magnet 8, there is no apprehension at all that the patterns, etc. printed on the top surface of the broadened center beam portion $5_2$ of the wire staple 5 will be damaged, along with the fact that the wire staple extruding projections 1, 1 are formed in a fork shape, even when the broadened center beam section $5_2$ contacts the magnet 8. It is also possible to magnetize the wire staple extruding projection 1, 1.

The pressure applying plate member 2, of the illustrated embodiment is further housed in an ornamental cover member 2, made of a synthetic resin material, in which it is tightly fitted and combined together with an adhesive agent. The pressure applying member 2, includes as the integral parts thereof the abovementioned wire staple extruding projections 1, 1, the pawls 9, bearings $2_2$, and a metal core plate. Further, according to the illustrated embodiment, an arm $3_2$ of the staple holding frame 3 is made of a leaf spring, and one end of the arm $3_2$ is bent in the shape of a letter "U" to form the jump-up spring 7 integrally therewith, and a hook portion $3_3$ to be hooked onto a pin 6 is formed at the end part of the above-mentioned arm $3_2$. The structure of the pressure applying plate member 2, the base plate 5, the jump-up spring 7, and so forth according to the present invention, however, are not limited to this embodiment alone. Incidentally, reference numerals 11 and 12 respectively designate projections for restricting the moving range of the pressure applying plate member 2, and arcuate grooves to be engaged with the projections provided at the sliding interface between the bearing $2_2$ of the pressure applying plate 2, and the bearing $5_1$ of the base plate 5.

Figure 8:
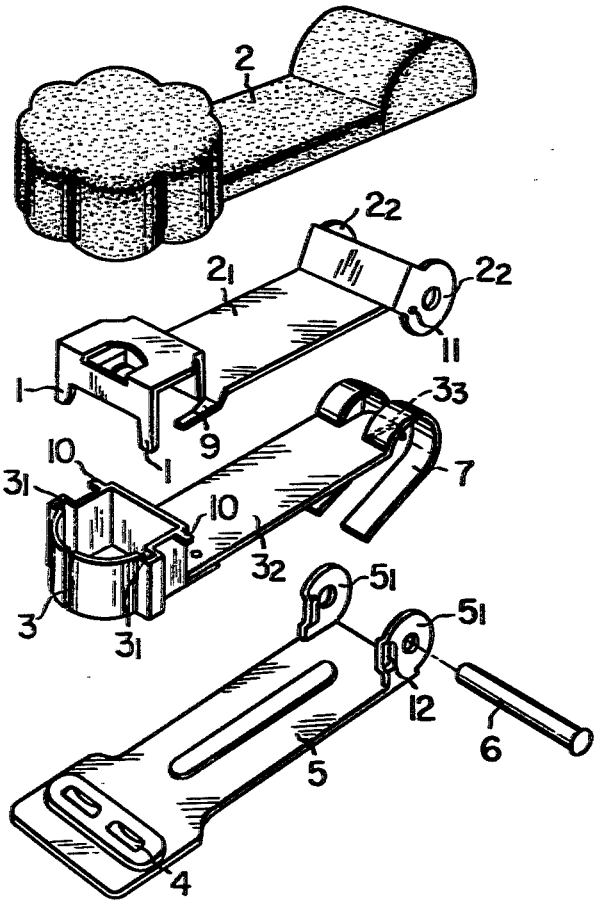
FIG. 8 is an exploded perspective view of the stapling machine shown in FIG. 7.
Figure 7:
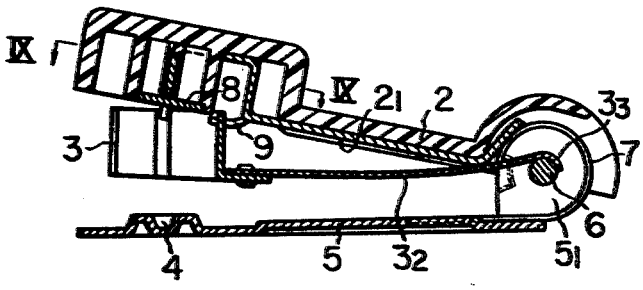
FIG. 7 is a side elevational view in longitudinal cross-section along the center line of another embodiment of the stapling machine according to the present invention.
Figure 9:
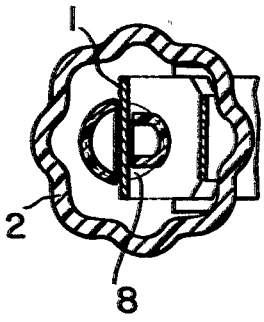
FIG. 9 is a transverse cross-sectional view taken along the line IX—IX in FIG. 7.

Referring now to FIGS. 7 to 9, which show a modification of the stapling machine according to the present invention, the wire staple extruding projections 1, 1 are constructed differently from the first embodiment in that the length of the wire staple extruding projections is shortened so as to increase the strength of the projections in the pressure applying direction. Also, the arm $3_2$ of the wire staple holding frame 3, made of a leaf spring, is not integrally formed with the pawl receiving section 10 to be engaged with the upwardly moving pawl 9, but it is separately provided and firmly joined to a flanged portion at the back side of the wire staple holding frame 3, whereby manufacturing process becomes simpler.

The ornamental cover member 2, unlike that shown in FIG. 1, is further extended to the rear end of the base plate 5 where the wire staple holding member 3 and the pressure applying member $2_1$ are pivotally connected together by a pivot pin 6, so that the cover member extends over the entire length of the stapling machine. As shown in FIG. 7, an angle of upward inclination at the rear end of the pressure applying member $2_1$ is different from that of the ornamental top cover member 2 so that the latter may be conformed to the curvature of the U-shaped spring 7 from the aesthetic standpoint. It may also be advantageous if the base plate 5 is strengthened against twisting or bending forces to be imparted thereto from outside by providing a raised section at the center part of the base plate 5 in the longitudinal direction thereof.

Thus, according to the present invention, as has so far been mentioned in the foregoing, the shape of the inner periphery of the staple wire holding frame 3 is shaped in a cylindrical form so as to conform to the shape of the staple wire 5 having the broadened center beam section $5_2$ which is wider than the staple points or legs $5_1$, $5_1$, whereby the wire staple 5 can be accurately inserted into the staple wire holding frame 3 while maintaining the right direction to the staple points receiving recess 4 in the base plate 5. In addition, the magnet 8 is provided on the lower surface of the cover member 2 for the pressure applying plate 2, so as to face to the broadened center beam section of the staple wire 5, by which the staple wire 5 is attracted to the magnet 8 at the innermost place of the holding frame 3 to be held at a definite position without apprehension of its unexpected fall down. Thus, the stapling machine according to the present invention is highly effective in the use of the ornamental wire staple in such special form as described above.

What is claimed is:

1. A stapling machine comprising in combination:

(a) a base plate having a wire staple receiving recess on one end part thereof, a pair of upright flanged portions at both sides on the opposite end part thereof, and a pivot pin passing through said upright flanged portions;

(b) wire staple holding means in a generally cylindrical configuration, the transverse cross-sectional shape thereof conforming to the shape of an ornamental wire staple having a broadened center beam section which is wider than the staple points at both side thereof, said means being provided with a pair of grooves to permit passage of the staple points, and a leaf spring, one end of which is connected with said wire staple holding means, and the other end of which is partially bent in a U-shape to provide a repulsive spring force and partially formed into a hook shape to be engaged with said pivot pin;

(c) a pressure applying member including a wire staple extruding member formed in a fork shape to freely slide into and out of said grooves formed in said wire staple holding means and a pair of upright flanged portions at both sides of the other end thereof forming bearings to receive said pivot pin therethrough to be pivotally connected with the upright flanged portions of said base plate; and (d) a magnet to attract and hold in position the wire staple placed in said wire staple holding means.

2. In a stapling machine having a pressure applying member provided with wire staple extruding projections and a wire staple holding frame beneath the pressure applying member, both being fitted in a pivotally movable manner through a pin to a base plate having a wire staple receiving recess, and a spring to cause the pressure applying member and the wire staple holding frame to spring up, the improvement wherein said wire staple holding frame is shaped in a cylindrical form having a cross-sectional shape conforming to the shape of said wire staple, in which the center portion between the two staple points in the U-shaped wire staple is made wider in width than said staple points, and a permanent magnet to attract said wire staple accommodated in said wire staple holding frame is provided at the lower surface of the pressure applying member.

* * * * *